US010407859B2

(12) United States Patent
Elfass et al.

(10) Patent No.: US 10,407,859 B2
(45) Date of Patent: Sep. 10, 2019

(54) METHOD AND LOADING MODULE TO MECHANICALLY INCREASE PILE/DRILLED SHAFT END BEARING STIFFNESS

(71) Applicant: Board of Regents of the Nevada System of Higher Education on Behalf of the University of Nevada, Reno, Reno, NV (US)

(72) Inventors: Sherif A. Elfass, Reno, NV (US); Gary M. Norris, Reno, NV (US)

(73) Assignee: BOARD OF REGENTS OF THE NEVADA SYSTEM OF HIGHER EDUCATION ON BEHALF OF THE UNIVERSITY OF NEVADA, RENO, Reno, NV (US)

( * ) Notice: Subject to any disclaimer, the term of this patent is extended or adjusted under 35 U.S.C. 154(b) by 0 days.

(21) Appl. No.: 16/081,018

(22) PCT Filed: Feb. 21, 2017

(86) PCT No.: PCT/US2017/018757
§ 371 (c)(1),
(2) Date: Aug. 29, 2018

(87) PCT Pub. No.: WO2017/147089
PCT Pub. Date: Aug. 31, 2017

(65) Prior Publication Data

US 2019/0071834 A1 Mar. 7, 2019

Related U.S. Application Data

(63) Continuation-in-part of application No. PCT/US2017/018744, filed on Feb. 21, 2017.
(Continued)

(51) Int. Cl.
*E02D 5/38* (2006.01)
*E02D 15/04* (2006.01)
*E02D 5/66* (2006.01)

(52) U.S. Cl.
CPC ..... *E02D 5/38* (2013.01); *E02D 5/665* (2013.01); *E02D 15/04* (2013.01)

(58) Field of Classification Search
CPC ..... E02D 5/38; E02D 5/62; E02D 7/28
See application file for complete search history.

(56) References Cited

U.S. PATENT DOCUMENTS 3,916,635 A 11/1975 Lynch et al.
4,018,056 A * 4/1977 Poma ..... E02D 5/36 405/233

(Continued)

FOREIGN PATENT DOCUMENTS

CH 347788 A * 7/1960 ..... E02D 5/30
DE 1634486 A1 * 2/1971 ..... E02D 5/50

(Continued)

OTHER PUBLICATIONS

Korean Intellectual Property Office, International Search Report and Written Opinion of the International Searching Authority for International Application No. PCT/US2017/018744, dated Apr. 21, 2017, 14 pages.

(Continued)

*Primary Examiner* — Frederick L Lagman
(74) *Attorney, Agent, or Firm* — Schwabe Williamson & Wyatt, P.C.

(57) ABSTRACT

Disclosed herein are a module, system and technique to enhance end bearing stiffness of pile/drilled shafts. In particular, methods, systems and loading modules which account for tip resistance in overall pile/shaft capacity are provided which increase the stiffness of the bearing soil. The (Continued)

techniques utilize a mechanical system to preload the soil under the shaft tip, thus allowing the users to confidently account for the gained resistance at an acceptable level of movement. Each shaft/pile is preloaded during construction to verify its load carrying capability.

6 Claims, 8 Drawing Sheets

Related U.S. Application Data

(60) Provisional application No. 62/298,252, filed on Feb. 22, 2016, provisional application No. 62/298,256, filed on Feb. 22, 2016.

(56) References Cited

U.S. PATENT DOCUMENTS

| | | | | | |
|---|---|---|---|---|---|
| 4,634,316 | A * | 1/1987 | Cernak | E02D 5/46 | 405/229 |
| 6,869,255 | B1 * | 3/2005 | Beck, III | E02D 33/00 | 405/233 |
| 7,909,541 | B1 * | 3/2011 | Beck, III | E02D 3/12 | 405/236 |
| 2007/0231079 | A1 * | 10/2007 | Gambill | E02D 5/62 | 405/228 |
| 2011/0056303 | A1 | 3/2011 | Hayes | | |
| 2016/0115763 | A1 * | 4/2016 | Lucido | E21B 33/13 | 166/177.4 |

FOREIGN PATENT DOCUMENTS

| | | | | | |
|---|---|---|---|---|---|
| EP | 0193513 | A1 * | 9/1986 | E02D 5/34 | |
| FR | 1516805 | A * | 2/1968 | E02D 5/385 | |
| GB | 788633 | A * | 1/1958 | E02D 5/30 | |
| JP | 58101926 | A * | 6/1983 | E02D 5/62 | |
| JP | 2-178413 | A | 7/1990 | | |
| JP | 3-894 | A | 1/1991 | | |
| JP | 2553648 | B2 | 11/1996 | | |
| JP | 10-195861 | A | 7/1998 | | |
| JP | 2001011849 | A | 1/2001 | | |
| JP | 2009052202 | A | 3/2009 | | |
| JP | 2013155558 | A | 8/2013 | | |
| JP | 2015140609 | A | 8/2015 | | |
| KR | 200313164 | Y1 | 5/2003 | | |
| KR | 101051428 | B1 * | 7/2011 | E02D 5/46 | |
| WO | WO-8604941 | A1 * | 8/1986 | E02D 5/62 | |
| WO | WO 86/05533 | * | 9/1986 | E02D 31/10 | |
| WO | WO 2013/089466 | * | 6/2013 | E02D 5/62 | |
| WO | WO-2017147083 | A1 * | 8/2017 | E02D 31/10 | |

OTHER PUBLICATIONS

Korean Intellectual Property Office, International Search Report and Written Opinion of the International Searching Authority for International Application No. PCT/US2017/018757, dated Apr. 21, 2017, 12 pages.

* cited by examiner

METHOD AND LOADING MODULE TO MECHANICALLY INCREASE PILE/DRILLED SHAFT END BEARING STIFFNESS

CROSS-REFERENCE TO RELATED APPLICATIONS

This application is a 371 U.S. National Stage of International Application No. PCT/US2017/018757, filed Feb. 21, 2017, which was published in English under PCT Article 21(2), which in turn claims the priority benefit of the earlier filing date of U.S. Provisional Application No. 62/298,256, filed Feb. 22, 2016, and is a Continuation in Part of International Application No. PCT/US17/18744, filed Feb. 21, 2017 which claims the priority benefit of U.S. Provisional Application No. 62/298,252, filed Feb. 22, 2016, each of which is hereby incorporated herein by reference in its entirety.

FIELD

The present disclosure relates generally to techniques for increasing pile/drilled shaft end bearing stiffness and more particularly, to methods and loading modules which account for tip resistance in overall pile/shaft capacity thereby increasing the stiffness of the bearing soil.

BACKGROUND

Drilled shafts are high-capacity cast-in-place deep foundation elements constructed in the soil using an auger. A hole having the design diameter of planned shaft is first drilled to the design depth. Full-length reinforcing steel is then lowered into the hole and the hole is filled with concrete. The finished foundation element resists compressive, uplift and lateral loads.

Designers of drilled shafts and long/large diameter piles do not typically include the tip resistance component in estimating its overall capacity due to excessive deformation needed to achieve such resistance. Post-grouting techniques were developed in response to this demand. These techniques typically entail, after construction of a drilled shaft, pushing grout (a mix of concrete, sand and water) under pressure through tubes embedded in the shaft and passing through the body of the shaft to the bottom of the shaft. This grout occupies the space between the bottom of the shaft and the soil and keeps pushing the soil in an attempt to improve its stiffness and its load carrying capacity.

These post-grouting techniques have been ascribed with several limitations including reliability and repeatability of the technique which has prevented it from being adopted by the construction industry. Thus, a need exists for new techniques and systems that improve drilled shaft/pile end-bearing resistance.

SUMMARY

Disclosed herein are methods, systems and loading modules which account for tip resistance in overall pile/shaft capacity thereby increasing the stiffness of the bearing soil. The disclosed methods, systems and loading modules provide the same effect as post-grouting techniques while overcoming the limitations associated with such techniques by utilizing a mechanical mechanism to deliver the load improvement capability.

In some embodiments, a method for increasing pile/drilled shaft end bearing stiffness is provided comprising drilling a hole having a diameter of the pile/drilled shaft to a desired depth; positioning one or more anchors for anchoring a reaction frame; positioning at least one loading rod tube, at least one cement slurry tube and a loading module in the hole, wherein the loading module comprises a base plate with a lip and at least one seating opening; positioning at least one loading rod down the loading rod tube so that it is seated within at least one seating opening of the base plate; securing the reaction frame to the pile/shaft body; compressing the at least one loading rod so that it pushes the base plate into the bearing soil and creates a void between the base plate and bottom soil; filling the void between the base plate and bottom soil with cement slurry; removing the at least one loading rod; and filling the loading tube with a cement slurry. In some embodiments, the methods and loading modules further comprise use of a deep foundation porewater dissipater that can be used to dissipate generated water pressure during earthquakes.

Also disclosed is a system for increasing pile/drilled shaft end bearing stiffness. In some embodiments, a system comprises a loading module comprising a base plate with a lip and at least one seating opening; one or more loading tubes for receiving one or more loading rods; one or more access tubes to deliver a void filling cement slurry; and one or more anchoring rods. In some embodiments, a system further comprises a reaction frame, one or more loading rods, and/or one or more hydraulic jacks. In some embodiments, the system further comprises a porewater pressure dissipater coupled to the loading module. In some embodiments, the porewater pressure dissipater comprises a cylindrical receptacle below the loading plate, filled with aggregate sealed to the base plate of the loading module.

A loading module utilized in the disclosed methods and systems is also provided. In some embodiments, a disclosed loading module includes a stiffened plate with a deep lip and a seating opening for at least one loading rod.

The foregoing and other features and advantages of the disclosure will become more apparent from the following detailed description, which proceeds with reference to the accompanying figures.

DETAILED DESCRIPTION

Disclosed herein are modules, systems and techniques to enhance end bearing stiffness of pile/drilled shafts. In particular, methods, systems and loading modules which account for tip resistance in overall pile/shaft capacity are provided which increase the stiffness of the bearing soil. The techniques utilize a mechanical system to preload the soil under the shaft tip, thus allowing the users to confidently account for the gained resistance at an acceptable level of movement. Each shaft/pile is preloaded during construction to verify its load carrying capability.

The disclosed techniques and modules are associated with multiple advantages. An advantage of the disclosed techniques and modules is it allows designers to confidently and systematically account for the forfeited tip resistance component in the overall pile/shaft capacity. The disclosed modules and loading mechanisms increase the stiffness of the bearing soil. Further, they allow users to consistently take advantage of a neglected and heretofore verifiable tip capacity. Thus, users will be able to reduce shaft lengths and/or diameters thus reducing the foundation cost of a project.

A disclosed loading module includes a stiffened plate with a deep lip and a seating opening for the loading rod. Other components which can be embedded in the shaft body include the following: one or more access tubes to deliver the void filling cement slurry; one or more access tubes for the loading rod; one or more anchorage rods for a reaction frame; and a cement slurry. Other reusable components utilized for the operation include one or more loading rods, a reaction frame and one or more hydraulic jacks.

In use, the stiffened base plate is pushed into the bearing soil using a loading rod, which passes through a tube embedded in the pile/shaft body. This loading rod reacts against a loading frame, which is secured to the pile/shaft body. For example, in larger pile/drilled shaft, more than one loading rod and tube may be used. Once the plate is pushed and set in position, the void created between the plate and the bottom of the pile/shaft is filled with a cement slurry, which is delivered through access tubes embedded in the pile/shaft body. The loading tube can also filled with the same cement slurry if needed. An optional attachment to the module is the porewater dissipater, for example as described in International Application No. PCT/US17/18744, filed Feb. 21, 2017, which is hereby incorporated herein by reference in its entirety.

Figure 1B:
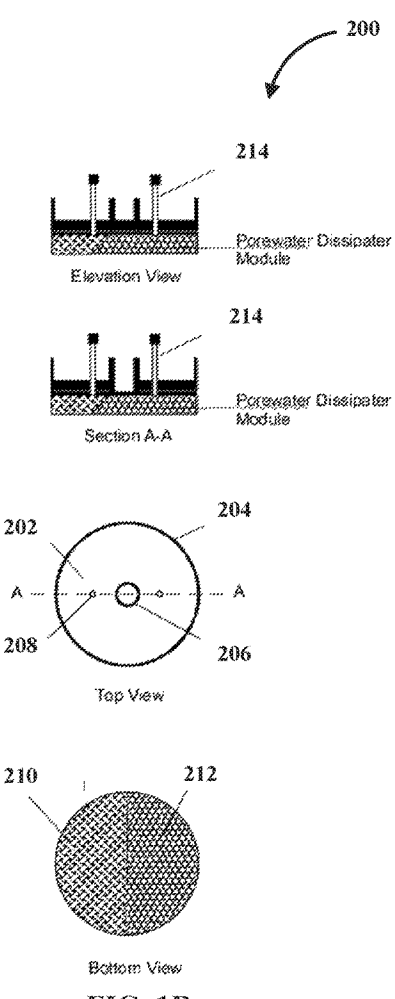
FIG. 1B provides multiple views of an exemplary loading module with a porewater dissipater module.
Figure 1A:
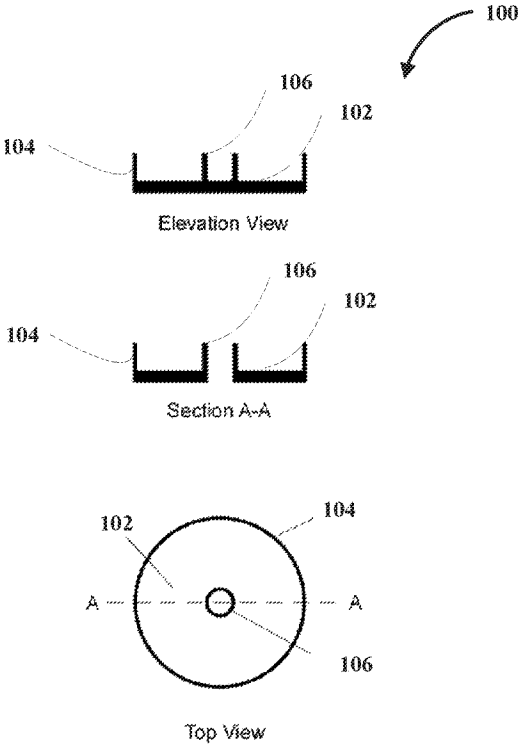
FIG. 1A provides multiple views of an exemplary loading module.
Figure 1C:
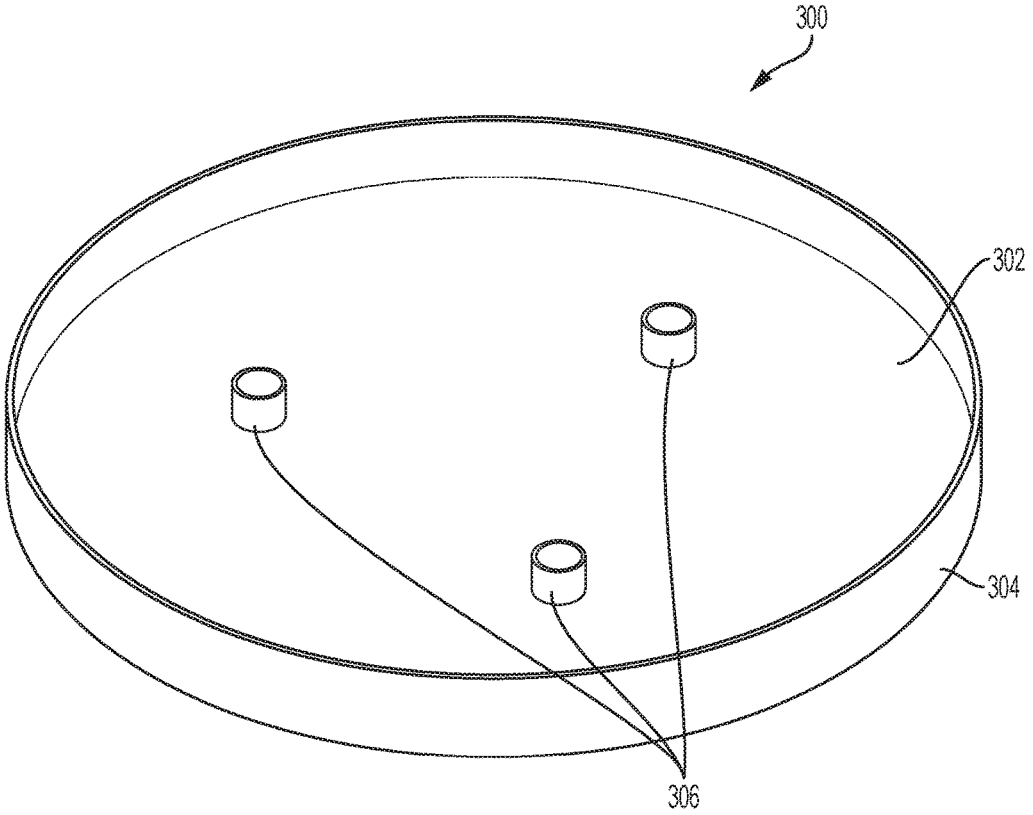
FIG. 1C is an additional exemplary loading module.

FIGS. 1A-1C provide exemplary loading modules. In particular, FIG. 1A provides multiple views of an exemplary loading module. In some embodiments, disclosed loading module 100 includes a base plate 102 including a lip 104, and a seating opening 108 in the center of base plate 102 for a loading rod, such as a mandrel. In some embodiments, plate 102 is a solid rigid plate with a deep lip 104 to retain the side soil when in use. In some embodiments, the vertical height of the lip 104 is greater than the anticipated displacement, such as in the range of about 4 to 12 inches, such as between 8 to 10 inches, 7 to inches 11 inches, including 4 inches, 4½ inches, 5 inches, 5½ inches, 6 inches, 6½ inches, 7 inches, 7½ inches, 8 inches, 8½ inches, 9 inches, 9½ inches, 10 inches, 10½ inches, 11 inches, 11½ inches or 12 inches. In some examples, an average range of 9 inches is utilized. Additionally, the angle of inclination of the lip can vary from about 45 to 60 degrees with the horizontal, such as between 45 to 50 degrees, 50 to 55 degrees, 50 to 60 degrees, 55 to 60 degrees, including 45 degrees, 46 degrees, 47 degrees, 48 degrees, 49 degrees, 50 degrees, 51 degrees, 52 degrees, 53 degrees, 54 degrees, 55 degrees, 56 degrees, 57 degrees, 58 degrees, 59 degrees, or 60 degrees. It is contemplated that plate 102 can be formed of any material that provides a desired stiffness, such as steel which allows the plate to be pushed into position without flexing/bending significantly. In some examples, plate 102 is a form of metal, other than steel, or reinforced precast concrete. In some examples, the dimensions including the thickness and/or shape of plate 102 are determined by the size and shape of the pile shaft body. In some examples, the thickness of the plate ranges between 0.25 inches and 2 inches. In one example, a plate with 0.25 inch thickness is used for a 1 foot wide pile shaft/pile body. In another example, a plate with 2 inch thickness is used for a 6 foot wide pile shaft body. In another example, a plate with 2 inch thickness with vertical stiffeners or webs is used for 12 foot wide pile shaft body. The plate surface is designed to have a diameter approximately equivalent to the diameter of the pile or shaft body ±2 inches. In some examples, plate 102 is circular with a 9 inch lip. In some examples, seating opening 108 has a diameter of 1 to 3 inches.

FIG. 1B provides multiple views of an exemplary loading module coupled to a porewater dissipater module. In some embodiments, disclosed loading module 200 includes a base plate 202 including a lip 204, one or more holes 208 through which one or more access tubes may travel, and a seating opening 206 for a loading rod, such as a mandrel. Base plate 202 comprises a top surface for coupling the dissipater to a pile/shaft and a bottom surface for sealing the cylindrical receptacle 210. In some embodiments, plate 202 is a solid rigid plate. In some embodiments, plate 202 is a solid rigid plate with a deep lip 204 to retain the side soil when in use. In some embodiments, the vertical height of the lip is greater than the anticipated displacement, such as in the range of about 4 to 12 inches, such as between 8 to 10 inches, 7 to 11 inches, including 4 inches, 4½ inches, 5 inches, 5½ inches, 6 inches, 6½ inches, 7 inches, 7½ inches, 8 inches, 8½ inches, 9 inches, 9½ inches, 10 inches, 10½ inches, 11 inches, 11½ inches or 12 inches. In some examples, the vertical height of lip 204 is 9 inches. Additionally, the angle of inclination of the lip can vary from about 45 to 60 degrees with the horizontal, such as between 45 to 50 degrees, 50 to 55 degrees, 50 to 60 degrees, 55 to 60 degrees, including 45 degrees, 46 degrees, 47 degrees, 48 degrees, 49 degrees, 50 degrees, 51 degrees, 52 degrees, 53 degrees, 54 degrees, 55 degrees, 56 degrees, 57 degrees, 58 degrees, 59 degrees, or 60 degrees. It is contemplated that plate 202 can be formed of any material that seals the dissipater and provides a flat surface thereby allowing the dissipater to be attached to the pile/shaft, such as to a bottom steel cage of the pile/shaft. In some examples, plate 202 is formed of metal, other than steel, or reinforced precast concrete. It is contemplated that plate 202 can be coupled to the cylindrical receptacle 210 by any means that allows the dissipater to be sealed. In some examples, the dimensions including the thickness and/or shape of plate 202 are determined by the size and shape of the pile shaft body, respectively, to which the dissipater is to be coupled. In some examples, the thickness of the plate ranges between 0.25 inches and 2 inches. In one example, a plate with 0.25 inch thickness is used for a 1 foot wide pile shaft body. In another example, a plate with 2 inch thickness is used for a 12 foot wide pile shaft body. The plate surface is designed to have a diameter approximately equivalent to the diameter of the pile or shaft body ±2 inches. In some examples, plate 202 is circular. In some examples each seating opening has a diameter of 1 to 3 inches.

Cylindrical receptacle 210 can be formed of any material that allows water to pass through, but not soil. In some examples, the cylindrical receptacle is formed of a rust resistant material, such as a geosynthetic fabric. In some examples, the cylindrical receptacle is made of a fine mesh made of plastic or metal such as a wire-mesh of a size that allows water to selectively flow through the receptacle, but not the native soil.

In one example, cylindrical receptacle 210 is formed of a geosynthetic fabric such as a woven, needle punched or heat bonded polyester and/or polypropylene fabric. In some examples, the metal has a mesh size between 75 to 200 microns, such as between 75 to 125 microns, 100 to 200 microns, including about 75 microns, 100 microns, 125 microns, 150 microns, 175 microns or 200 microns. In one example, the geosynthetic fabric has an apparent opening size equivalent to the abovementioned metal mesh sizes. In some examples, the cylindrical receptacle is designed to have a diameter approximately equivalent to the diameter of the pile or shaft ±2 inches to which the dissipater is to be attached.

In some embodiments, relatively uniform aggregate 212 in contained within the cylindrical receptacle 210. In some embodiments, relatively nonuniform aggregate 212 in contained within the cylindrical receptacle 210. The shape and/or size of aggregate, including gravel, is such to maximize the void space and allow water to pass through without clogging it. In some examples, uniform aggregate shape and size range is within ±10%, such as ±9%, ±8%, ±7%, ±6%, ±5%, ±4%, ±3%, ±2%, ±1%. In some examples, the aggregate is arranged to provide between a 3 inch sieve to U.S. No. 200 sieve. In one example, it forms a 3-inch sieve size. In use, the aggregate is placed in cylindrical receptacle 210, such as a geosynthetic bag, which has a similar diameter as the pile/shaft and allows water to pass from the soil on lateral and bottom sides of the pile/shaft tip, but does not allow the native soil to pass through.

As shown in FIG. 1B, base plate 202 includes one or more openings for one or more access tubes. An access tube 214 comprises a first end and a second end. The first end of access tube 214 is coupled to plate 202 so that it is aligned around the opening within plate 202 thereby forming a passageway into the cavity of cylindrical receptacle 210. In some embodiments, a first end of access tube 214 is coupled to plate 202 by welding. In some embodiments, a coupling element is positioned on the second end of access tube 214 to allow coupling of an additional access tube so that water can travel from the dissipater to an outlet surface. In some embodiments, a coupling element comprises internal threads on an interior surface to allow an additional access tube which comprises external threads complementing the internal threads of the coupling element to be securely coupled to base plate 202. Alternatively, in some embodiments one or more access tubes coupled to the one or more openings in the plate for receiving one or more access tubes of sufficient length so that each tube reaches an outlet surface and does not require a coupling element or coupling of an additional access tubes.

In some embodiments, a coupling element, access tube and additional access tube are formed of the same material. In some embodiments, a coupling element and additional access tube are formed of the same material while the access tube coupled, such as welded, to base plate 202 is formed of a different material. In some embodiments, the diameters of the two access tubes are the same to facilitate the flow of water. The diameter of the access tubes can be dependent upon the pile body/shaft diameter size. In use, an access tube can pass through the body of a pile all the way to an outlet surface where water can be safely discharged or be reused.

In some embodiments, a disclosed base plate 202 includes a plurality of openings, such as two, three, four, five, six, seven, eight, nine, ten or more openings for receiving access tubes thereby allowing a plurality of access tubes to be coupled and multiple passageways formed for water to flow from the bearing soil to an outlet surface. These multiple openings for receiving access tubes are in addition to the one center seating opening 206. The number of access tubes and couplers may vary depending upon the conditions of the soil and support desired. For example, a 6 to 8 foot pile shaft can include multiple access tubes for facilitating dissipating pressure from water buildup. In some examples, one access tube is utilized for every two square-feet of a pile shaft body.

FIG. 1C provides an additional exemplary loading module. In some embodiments, disclosed loading module 300 includes a base plate 302 including a lip 304, and multiple seating openings 306 for receiving multiple loading rods. In some embodiments, plate 302 is a solid rigid plate with a deep lip 304 to retain the side soil when in use. In some embodiments, the vertical height of the lip is greater than the anticipated displacement, such as in the range of about 4 to 12 inches, such as between 8 to 10 inches, 7 to 11 inches, including 4 inches, 5 inches, 6 inches, 7 inches, 8 inches, 9 inches, 10 inches, 11 inches or 12 inches. In some examples, the vertical height of lip 304 is 9 inches. Additionally, the angle of inclination of the lip can vary from about 45 to 60 degrees with the horizontal, such as between 45 to 50 degrees, 50 to 55 degrees, 50 to 60 degrees, 55 to 60 degrees, including 45 degrees, 46 degrees, 47 degrees, 48 degrees, 49 degrees, 50 degrees, 51 degrees, 52 degrees, 53 degrees, 54 degrees, 55 degrees, 56 degrees, 57 degrees, 58 degrees, 59 degrees, or 60 degrees. In some examples, each seating opening has a diameter of 1 to 3 inches. It is contemplated that plate 302 can be formed of any material that provides a desired stiffness, such as steel or as described herein for the other embodiments which allows the plate to be pushed into position without flexing/bending significantly. In some examples, plate 302 is form of metal, other than steel or reinforced precast concrete. In some examples, the dimensions including the thickness and/or shape of plate 302 are determined by the size and shape of the pile shaft body. In some examples, the thickness of the plate ranges between 0.25 inches and 2 inches. In one example, a plate with 0.25 inch thickness is used for a 1 foot wide pile shaft body. In another example, a plate with 2 inch thickness is used for a 12 foot wide pile shaft body. The plate surface is designed to have a diameter approximately equivalent to the diameter of the pile or shaft body ±2 inches. In some examples, plate 302 is circular having a 9 inch lip and three seating openings each positioned equidistant from each other.

Figure 2:
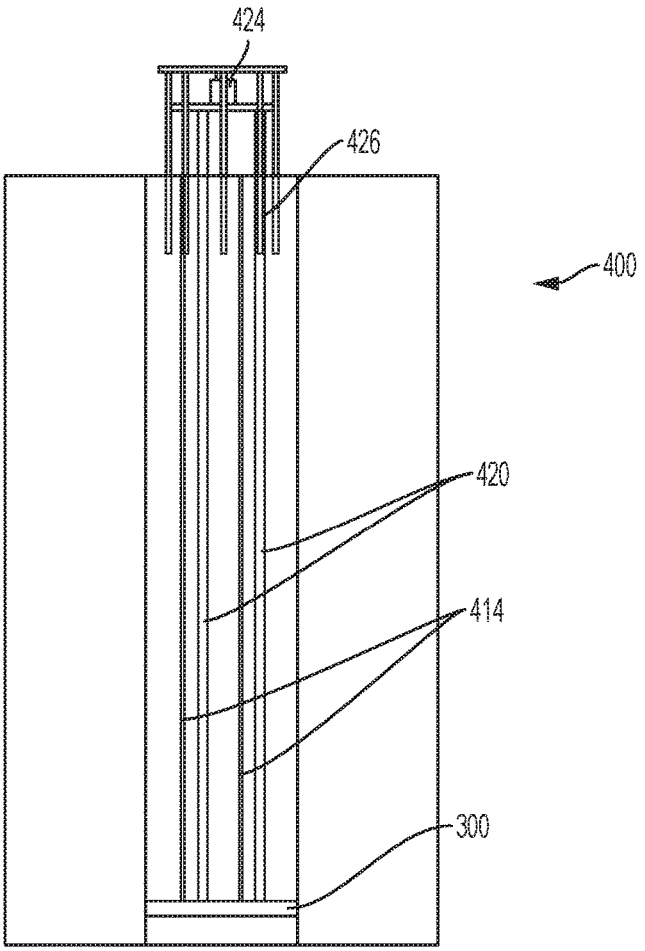
FIG. 2 is a side view of an exemplary assembly it its entirety.
Figure 3:
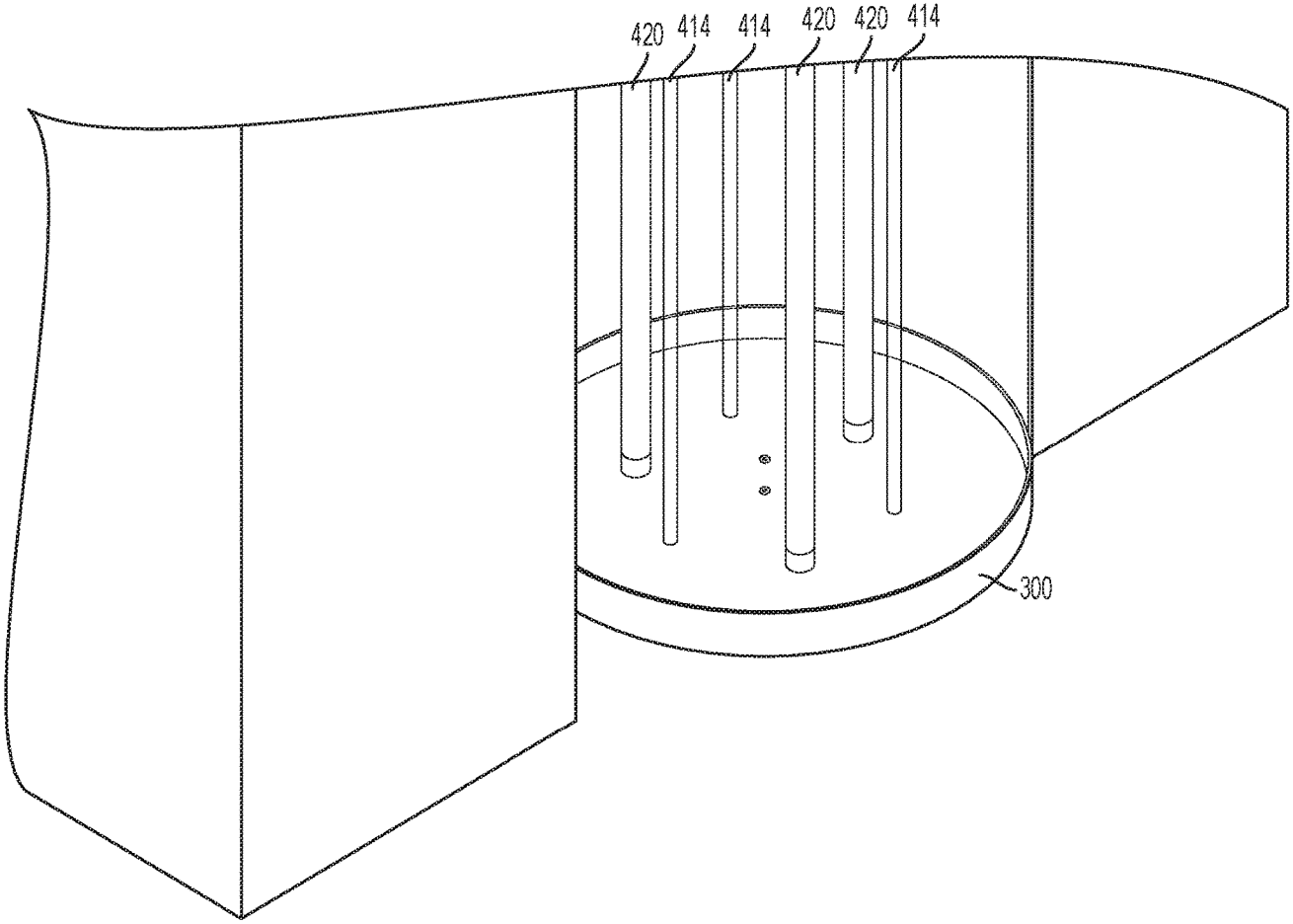
FIG. 3 illustrates positioning of an exemplary base plate prior to pushing.
Figure 4:
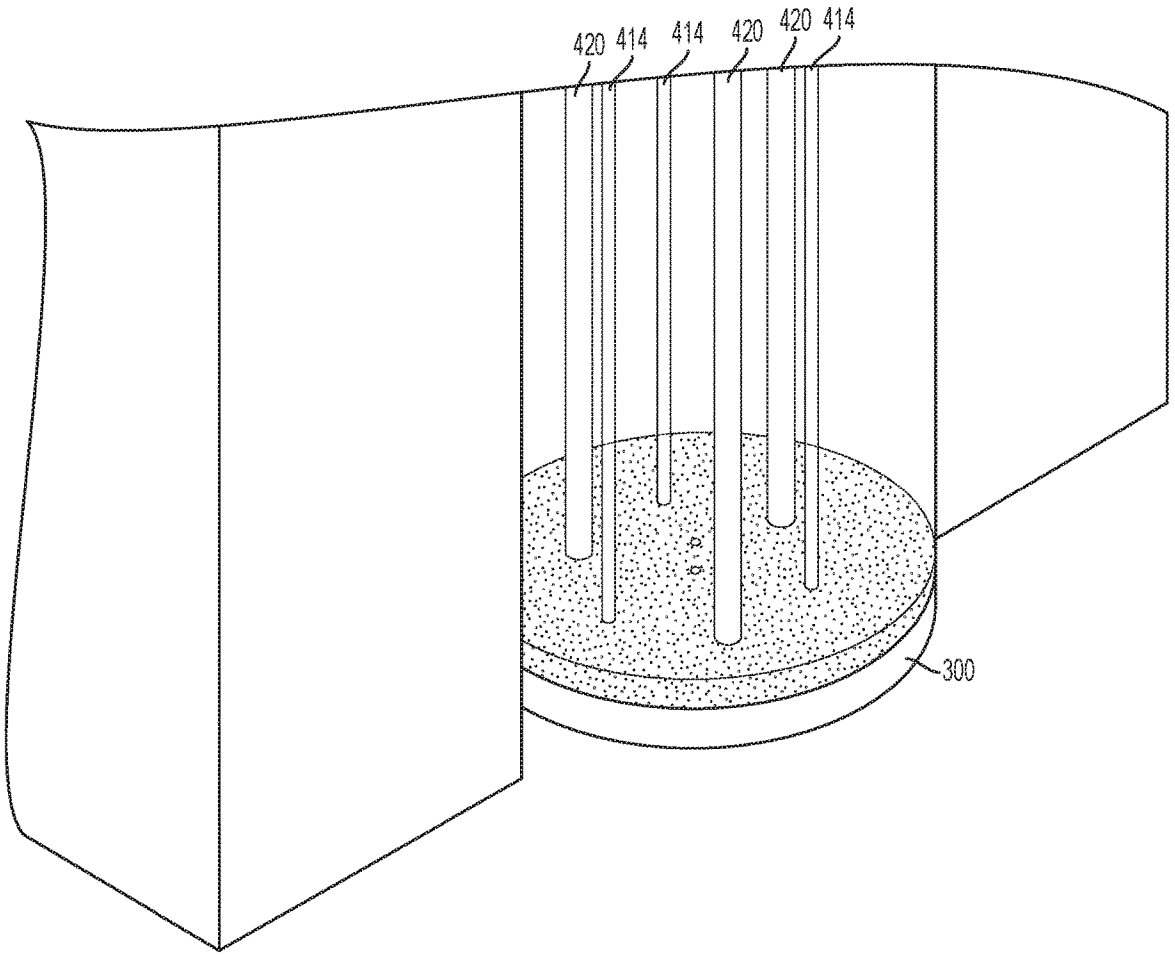
FIG. 4 illustrates positioning of an exemplary base plate after pushing and filling the induced void with concrete slurry.
Figure 5:
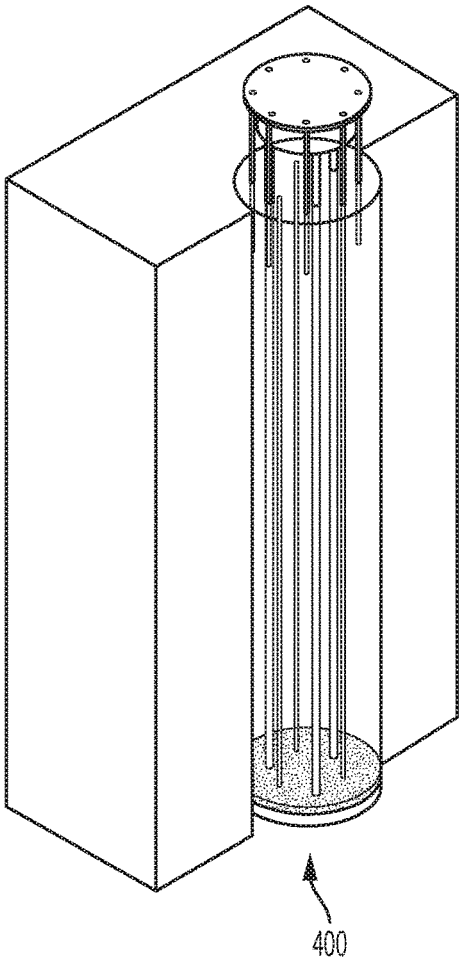
FIG. 5 is an exemplary assembly it its entirety after pushing and filling the induced void with concrete slurry.

FIGS. 2-5 provide views of an exemplary assembly 400 including loading module 300. FIG. 2 provides a side view of exemplary assembly 400 including loading module 300, loading arms 420, access tubes 414 for sending a concrete slurry down to fill the void created by loading module 300, a hydraulic jack 424, and reaction frame 426 including rods to engage the shaft body as a reaction for self-equilibrium while pushing the plate down and the top plate. FIG. 3 provides an illustration of loading module 300 prior to pushing it into place. FIG. 4 then illustrates positioning of loading module 300 after pushing and filling the induced void with the concrete slurry. FIG. 5 is a model of an exemplary assembly 400 it its entirety after pushing and void filling with the concrete slurry.

Figure 6:
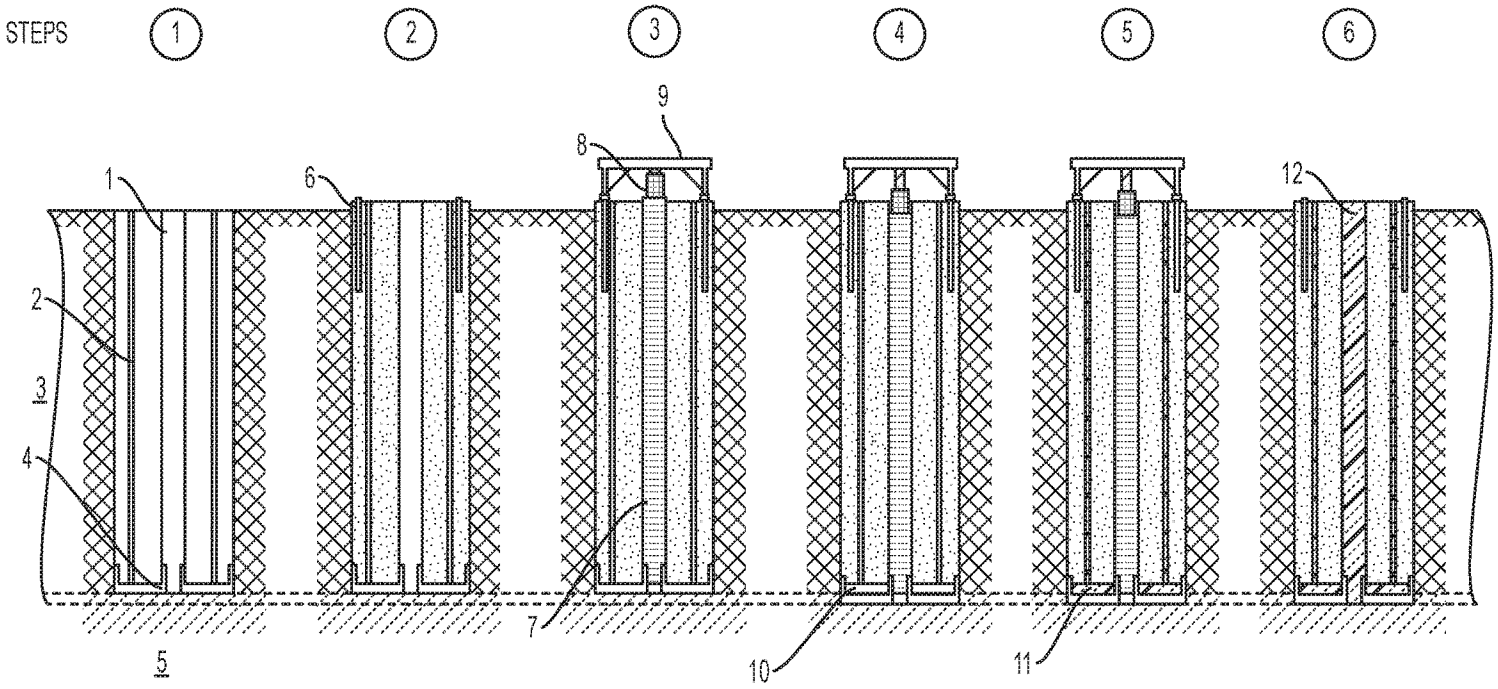
FIG. 6 is a schematic illustrating an exemplary method of installing a tip load module and an associated loading mechanism.

FIG. 6 is provides a schematic illustrating an exemplary method of installing a tip load module and an associated loading mechanism. A hole having the design diameter of planned shaft is first drilled to the design depth. A tube to house the loading rod (1), tubes to deliver a cement slurry (2), and a disclosed loading module (3) are positioned in the hole (step 1). Components for anchoring (6) a reaction frame are positioned in the hole (step 2) A loading rod (7) is positioned within the center of the stiffened base plate and reacts against a reaction frame (9), which is secured to the pile/shaft body (step 3). One or more hydraulic jacks (8) is used to compress the loading rod (7) which in turn pushes the base plate into the bearing soil and creates a void (10) between the base plate and bottom soil (step 4). The void created between the plate and the bottom is filled (11) with a cement slurry (step 5), which is delivered through the access tubes (2) embedded in the pile/shaft body. The loading rod (7) is then removed and the loading tube (1) is filled with a cement slurry (12, step 6). The finished foundation element resists compressive, uplift and lateral loads.

Figure 7:
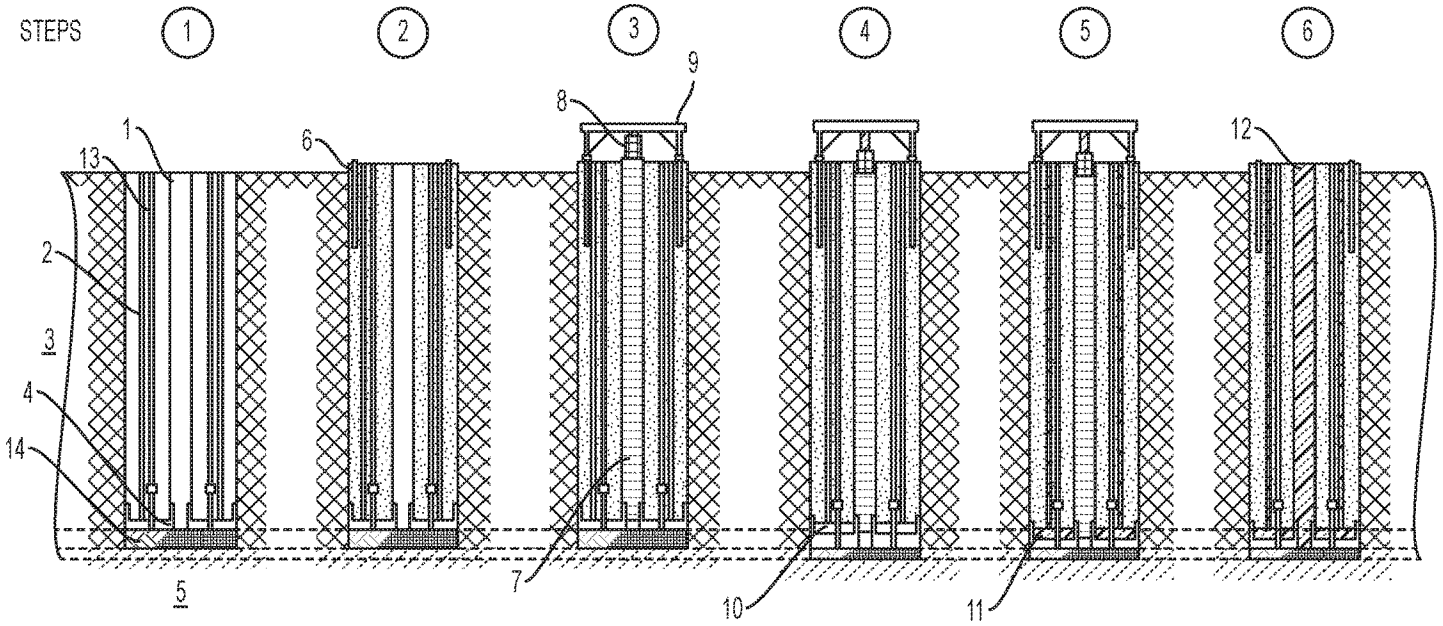
FIG. 7 is a schematic illustrating an exemplary method of installing a tip load module combined with an exemplary porewater dissipater module and an associated loading mechanism.

FIG. 7 is a schematic illustrating an exemplary method of installing a tip load module combined with an exemplary porewater dissipater module and an associated loading mechanism. A hole having the design diameter of planned shaft is first drilled to the design depth. A tube to house the loading rod (1), tubes to deliver a cement slurry (2), access tubes for a porewater dissipater module (13), a porewater dissipater module (14) and a disclosed loading module (3) are positioned in the hole (step 1). Components for anchoring (6) a reaction frame are positioned in the hole (step 2) A loading rod (7) is positioned within the center of pile/shaft and body and into the stiffened base plate and reacts against a reaction frame (9), which is secured to the pile/shaft body (step 3). A hydraulic jack (8) is used to compress the loading rod (7) which in turn pushes the base plate into the bearing soil and creates a void (10) between the base plate and bottom soil (step 4). The void created between the plate and the bottom is filled (11) with a cement slurry (step 5), which is delivered through the access tubes (2) embedded in the pile/shaft body. The loading rod (7) is then removed and the loading tube (12) is filled with a cement slurry (step 6). The finished foundation element resists compressive, uplift and lateral loads.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A method for increasing pile/drilled shaft end bearing stiffness, comprising:

drilling a hole having a diameter of the pile/drilled shaft to a desired depth;

positioning at least one loading rod tube, at least one cement slurry tube and a loading module in the hole, wherein the loading module comprises a base plate with a lip and at least one seating opening;

positioning at least one loading rod down the loading rod tube so that it is seated within the at least one seating opening of the base plate;

pushing the at least one loading rod so that it pushes the base plate into a bearing soil and creates a void between the base plate and bottom soil;

filling the void between the base plate and bottom soil with cement slurry;

removing the at least one loading rod; and filling the loading tube with a cement slurry.

2. The method of claim 1, wherein pushing the at least one loading rod comprises utilizing a hydraulic jack to compress the loading rod.

3. The method of claim 1, wherein the base plate comprises three seating openings.

4. The method of claim 3, wherein three loading rods are used to push the base plate into beating soil and create a void between the base plate and bottom soil.

5. The method of claim 1, wherein the loading module further comprises a porewater pressure dissipater.

6. The method of claim 5, wherein the porewater pressure dissipater comprises a cylindrical receptacle and uniform or nonuniform aggregate positioned within the receptacle and sealed by the base plate of the loading module.

* * * * *